US005563623A

United States Patent [19]

Barrett, Jr.

[11] Patent Number: 5,563,623

[45] Date of Patent: Oct. 8, 1996

[54] METHOD AND APPARATUS FOR DRIVING AN ACTIVE ADDRESSED DISPLAY

[75] Inventor: Raymond L. Barrett, Jr., Ft. Lauderdale, Fla.

[73] Assignee: Motorola, Inc., Schaumburg, Ill.

[21] Appl. No.: 344,052

[22] Filed: Nov. 23, 1994

[51] Int. Cl.[6] ..... G09G 3/36

[52] U.S. Cl. ..... 345/98; 345/97

[58] Field of Search ..... 345/87–103

[56] References Cited

U.S. PATENT DOCUMENTS

| | | |
|---|---|---|
| 4,755,971 | 7/1988 | Jasmer et al. . |
| 4,811,245 | 3/1989 | Bunker et al. . |
| 4,866,520 | 9/1989 | Nomura et al. . |
| 5,018,076 | 5/1991 | Johary et al. . |
| 5,091,723 | 2/1992 | Kanno et al. . |

FOREIGN PATENT DOCUMENTS

| | | |
|---|---|---|
| 9210235 | 2/1992 | European Pat. Off. . |
| 0507061 | 10/1992 | European Pat. Off. . |

OTHER PUBLICATIONS

B. Clifton et al, "Hardware Architectures for Video–Rate, Active Addressed STN display", Japan Display, 92, pp. 503–506.

T. J. Scheffer et al, "Active Addressing Method for High–Contrast Video–Rate STN Displays", SID 92 Digest, pp. 228–231.

*Primary Examiner*—Ulysses Weldon
*Attorney, Agent, or Firm*—James A. Lamb

[57] ABSTRACT

A display system (500) processes an input signal to generate an image. The input signal includes successive frames of data defining lines which include image values and have a line direction. A display (100) for displaying the image has second electrodes (104) which are in a direction corresponding to the line direction. A video memory (640) which stores a frame of data includes a single line buffer (602) and a single frame buffer (608). A controller (622) controls storage of the frame of data into the video memory (640) and generates a predetermined image independent function during a time slot. A calculation engine (632) computes an image dependent output signal during the time slot which has values. Each of the values is determined from the predetermined image independent function and image values from one of the lines stored in the video memory (640).

14 Claims, 11 Drawing Sheets

$$\begin{bmatrix} 1 & 1 & 1 & 1 & 1 & 1 & 1 & 1 \\ 1 & 1 & 1 & 1 & -1 & -1 & -1 & -1 \\ 1 & 1 & -1 & -1 & -1 & -1 & 1 & 1 \\ 1 & 1 & -1 & -1 & 1 & 1 & -1 & -1 \\ 1 & -1 & -1 & 1 & 1 & -1 & -1 & 1 \\ 1 & -1 & -1 & 1 & -1 & 1 & 1 & -1 \\ 1 & -1 & 1 & -1 & -1 & 1 & -1 & 1 \\ 1 & -1 & 1 & -1 & 1 & -1 & 1 & -1 \end{bmatrix}$$

300

500

700

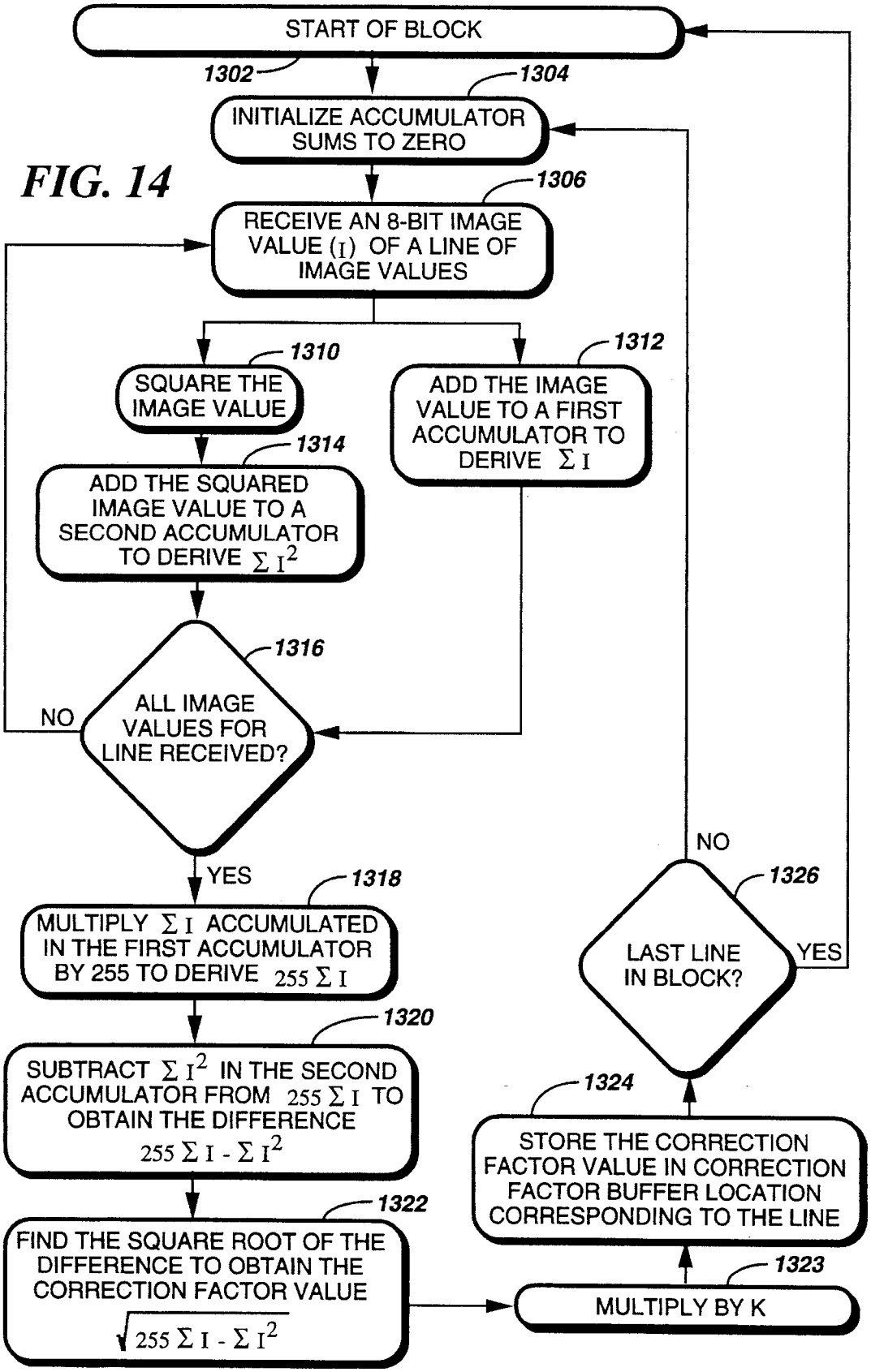
FIG. 14
START OF BLOCK
1302
1304
INITIALIZE ACCUMULATOR SUMS TO ZERO
1306
RECEIVE AN 8-BIT IMAGE VALUE (I) OF A LINE OF IMAGE VALUES
1310
SQUARE THE IMAGE VALUE
1312
ADD THE IMAGE VALUE TO A FIRST ACCUMULATOR TO DERIVE ΣI
1314
ADD THE SQUARED IMAGE VALUE TO A SECOND ACCUMULATOR TO DERIVE ΣI²
1316
ALL IMAGE VALUES FOR LINE RECEIVED?
NO
YES
1318
MULTIPLY ΣI ACCUMULATED IN THE FIRST ACCUMULATOR BY 255 TO DERIVE 255ΣI
1320
SUBTRACT ΣI² IN THE SECOND ACCUMULATOR FROM 255ΣI TO OBTAIN THE DIFFERENCE 255ΣI - ΣI²
1322
FIND THE SQUARE ROOT OF THE DIFFERENCE TO OBTAIN THE CORRECTION FACTOR VALUE √(255ΣI - ΣI²)
1323
MULTIPLY BY K
1324
STORE THE CORRECTION FACTOR VALUE IN CORRECTION FACTOR BUFFER LOCATION CORRESPONDING TO THE LINE
1326
LAST LINE IN BLOCK?
NO
YES

METHOD AND APPARATUS FOR DRIVING AN ACTIVE ADDRESSED DISPLAY

FIELD OF THE INVENTION

This invention relates in general to electronic displays, and more specifically to a method and apparatus for driving an active addressed, root-mean-square (rms) responding display system to reduce memory requirements and power consumption.

BACKGROUND OF THE INVENTION

An example of a direct multiplexed, rms responding electronic display is the well-known liquid crystal display (LCD). In such displays, a nematic liquid crystal material is positioned between two parallel glass plates having electrodes applied to each surface in contact with the liquid crystal material. The electrodes typically are arranged in vertical columns on one plate and horizontal rows on the other plate for driving a picture element (pixel) wherever a column and row electrode overlap. A high information content display, e.g., a display used as a monitor in a portable laptop computer, requires a large number of pixels to portray arbitrary patterns of information. Matrix LCDs having four hundred eighty rows and six hundred forty columns forming 307,200 pixels are widely used in computers today, and matrix LCDs with millions of pixels are expected soon.

In so-called rms responding displays, the optical state of a pixel is substantially responsive to the square of the voltage applied to the pixel, i.e., the difference in the voltages applied to the electrodes on the opposite sides of the pixel. LCDs have an inherent time constant that characterizes the time required for the optical state of a pixel to return to an equilibrium state after the optical state has been modified by changing the voltage applied to the pixel. Recent technological advances have produced LCDs with time constants approaching the frame period used in many video displays (approximately 16.7 milliseconds). Such a short time constant allows the LCD to respond quickly and is especially advantageous for depicting motion without noticeable smearing of the displayed image.

An active addressing method is typically used to optimize the contrast ratio of an LCD being used for video information display. In the typically used active addressing method, video information consisting of frames of image values is organized in a sequence of rows of image values which are transmitted to the display system. Each image value represents a value (gray scale values in a black and white, gray scale system) of a pixel in the image which is to be presented at a pixel in the display. The active addressing method continuously drives the row electrodes with signals comprising a train of periodic pulses having a common period T corresponding to the frame period. The row signals are independent of the image to be displayed and preferably are orthogonal and normalized, i.e., orthonormal. The term orthogonal denotes that if the amplitude of a signal applied to one of the rows is multiplied by the amplitude of a signal applied to another one of the rows, the integral of this product over the frame period is zero. The term normalized denotes that all the row signals have the same rms voltage integrated over the frame period T.

A problem with active addressing results from the large number of calculations required per second. For example, a gray scale display having four hundred eighty rows and six hundred forty columns, and a frame rate of 60 frames per second requires just under ten billion calculations per second. Typical currently available display systems using active addressing have two sets of video image memory, each set capable of storing the four hundred eighty by six hundred forty image values, each image value being typically an eight bit value. One of the sets of memory is used to assemble a frame of image values on a row by row basis, while the second set of memory is used as a source of image values in which columns of the image values remain constant for a frame period. Such constancy of column information is important to prevent jitter and smearing of the image. Although it is possible with today's technology to perform calculations at the rate described, the architectures proposed to date for calculation engines used for actively addressed displays have not been optimized to minimize memory requirements. The memory requirement issue is particularly important in portable applications, wherein excessive memory results in an excessive power requirement, larger parts, and a higher cost of the memory. The excessive power requirement is particularly important in such portable applications as battery-powered laptop computers, in which size, and battery life are primary design considerations.

Thus, what is needed is a method and apparatus for controlling and driving an actively addressed display in a manner that minimizes the memory requirements and thus also minimizes the power consumption and size of the image processing system.

SUMMARY OF THE INVENTION

In a first aspect of the present invention, a display system processes an input signal to generate an image. The input signal includes successive frames of data, each defining a plurality of successively transmitted lines of image values. The lines have a line direction. The display system includes an active addressed display, a video memory, a controller, a calculation engine, a first driver element, and a second driver element.

The active addressed display is for displaying the image and has a plurality of first electrodes and a plurality of second electrodes which cross each other at intersection points forming pixels. The plurality of second electrodes are in a direction corresponding to the line direction. The video memory comprises a single line buffer and a single frame buffer. The single line buffer is coupled to the input signal and is for accumulating a stored line which includes one of the plurality of successively transmitted lines of image values. The single frame buffer is coupled to the single line buffer and is for storing a frame of data including a plurality of the stored lines. The controller is coupled to the video memory. The controller transfers the stored line from said single line buffer into said single frame buffer after the stored line is completely stored in said single line buffer and generates a predetermined image independent function having at least M values during a time slot. The calculation engine is coupled to the controller and the video memory. The calculation engine computes an image dependent output signal during the time slot. The image dependent output signal has N values. Each of the N values is determined from the predetermined image independent function and one of N sets of image values. The calculation engine reads each of the N sets of image values from a different one of the plurality of the stored lines stored in said single frame buffer. The first driver element is coupled to the controller and the active addressed display. During the time slot the first driver circuit generates at M first voltages which are coupled to M first electrodes. Each of the M first voltages is proportional to one of the at least M values. The second driver element is coupled to the calculation engine and the active addressed display. During the time slot the second driver element generates N second voltages which are coupled to N second electrodes. Each of the N second voltages is proportional to one of the N values.

In a second aspect of the present invention, a display system processes an input signal to generate an image. The input signal includes successive frames of data defining a plurality of successively transmitted columns of image values. The display system includes an active addressed display, a video memory, a controller, a calculation engine, a row driver element, and a column driver element.

The active addressed display is for displaying the image and has a plurality of row electrodes and a plurality of column electrodes which cross each other at intersection points forming pixels. The video memory is for storing the frame of data and includes a single column buffer and a single frame buffer. The single column buffer is coupled to the input signal and is for accumulating a stored column which includes one of the plurality of successively transmitted columns of image values. The single frame buffer is coupled to the single column buffer and is for storing a frame of data comprising a plurality of the stored columns. The controller is coupled to the video memory. The controller transfers the stored column from said single column buffer into said single frame buffer while image values from a corresponding stored column are not being read from said single frame buffer and after the stored column is completely stored in said single column buffer. The controller generates a predetermined image independent function having at least M values during a time slot The calculation engine is coupled to the controller and the video memory. The calculation engine computes an image dependent output signal during the time slot. The image dependent output signal has N values. Each of the N values is determined from the predetermined image independent function and one of N sets of image values, and wherein said calculation engine reads each of the N sets of image values from a different one of the plurality of the stored columns stored in the single frame buffer. The row driver element is coupled to the controller and the active addressed display. The row driver circuit generates M row voltages which are coupled to M row electrodes. Each of the M row voltages is proportional to one of the M values during the time slot. The column driver element is coupled to the calculation engine and the active addressed display. The column driver element generates N column voltages which are coupled to N column electrodes. Each of the N column voltages is proportional to one of the N values during the time slot.

In a third aspect of the present invention, a method is for use in an electronic device which processes a input signal to generate an image on an active addressed display. The input signal includes a frame of data defining a plurality of successively transmitted lines of image values. The plurality of successively transmitted lines have a line direction. The method includes the steps of accumulating, transferring, generating, reading, computing, repeating, generating first voltages, and generating second voltages.

In the step of accumulating, a stored line comprising one of the plurality of successively transmitted lines of image values is accumulated in a single line buffer. In the step of generating, a predetermined image independent function having at least M values is generated during a time slot. In the step of reading, a plurality of image values is read from one of the plurality of the stored lines stored in the single frame buffer. In the step of computing, one of N values of an image dependent output signal is computed during the time slot. Each of the N values is determined from the predetermined image independent function and the plurality of image values read in the step of reading. In the step of repeating, the steps of reading and computing are repeated N times during the time slot, using a different one of the plurality of the stored lines for each repetition. In the step of generating first voltages, M first voltages are generated during the time slot which are coupled to M first electrodes of the active addressed display. Each of the M first voltages is proportional to one of the at least M values of the predetermined image independent function. In the step of generating second voltages, N second voltages are generating during the time slot which are coupled to N second electrodes of the active addressed display which have a direction corresponding to the line direction. Each of the N second voltages is proportional to one of the N values.

In a fourth aspect of the present invention, an electronic device includes a microcomputer, an enclosure, and a display system. The microcomputer is for transmitting an input signal including successive frames of data, each frame defining a plurality of successively transmitted lines of image values. The plurality of successively transmitted lines have a line direction. The enclosure is coupled to the microcomputer for supporting and protecting the microcomputer and display system. The display system is coupled to the microcomputer and processes the input signal to generate an image. The display system includes an active addressed display, a video memory, a controller, a calculation engine, a first driver element, and a second driver element.

The active addressed display is for displaying the image and has a plurality of first electrodes and a plurality of second electrodes which cross each other at intersection points forming pixels. The plurality of second electrodes are in a direction corresponding to the line direction. The video memory comprises a single line buffer and a single frame buffer. The single line buffer is coupled to the input signal and is for accumulating a stored line which includes one of the plurality of successively transmitted lines of image values. The single frame buffer is coupled to the single frame buffer and is for storing a frame of data including a plurality of the stored lines. The controller is coupled to the video memory. The controller transfers the stored line from said single line buffer into said single line buffer after the stored line is completely stored in said single line buffer and generates a predetermined image independent function having at least M values during a time slot. The calculation engine is coupled to the controller and the video memory. The calculation engine computes an image dependent output signal during the time slot. The image dependent output signal has N values. Each of the N values is determined from the predetermined image independent function and one of N sets of image values. The calculation engine reads each of the N sets of image values from a different one of the plurality of the stored lines stored in said single frame buffer. The first driver element is coupled to the controller and the active addressed display. During the time slot the first driver circuit generates at M first voltages which are coupled to M first electrodes. Each of the M first voltages is proportional to one of the at least M values. The second driver element is coupled to the calculation engine and the active addressed display. During the time slot the second driver element generates N second voltages which are coupled to N second electrodes. Each of the N second voltages is proportional to one of the N values.

BRIEF DESCRIPTION OF THE DRAWINGS

FIG. 14 is a flow chart depicting the operation of the rms correction factor calculator in accordance with the preferred and alternate embodiments of the present invention.

DETAILED DESCRIPTION OF THE PREFERRED EMBODIMENT

A display processing system in accordance with a preferred and alternate embodiments of the present invention is described in more detail below in which the display processing system drives a display having first electrodes and second electrodes to display an image which is transmitted to the display processing system in successive frames consisting of lines of image values, in which the direction (row or column) of the lines corresponds to the direction of the second electrodes. During each of a plurality of time slots, the first electrodes are driven with a predetermined image independent signal and the second electrodes are driven with an image dependent signal. During each time slot, the image dependent signal has a plurality of values, one for each second electrode. The unique architecture described below in accordance with the preferred and alternate embodiments of the present invention calculates each value of the image dependent signal based on only one line of transmitted image values, which minimizes image value memory requirements and interconnection requirements of the display processing system.

Figure 1:
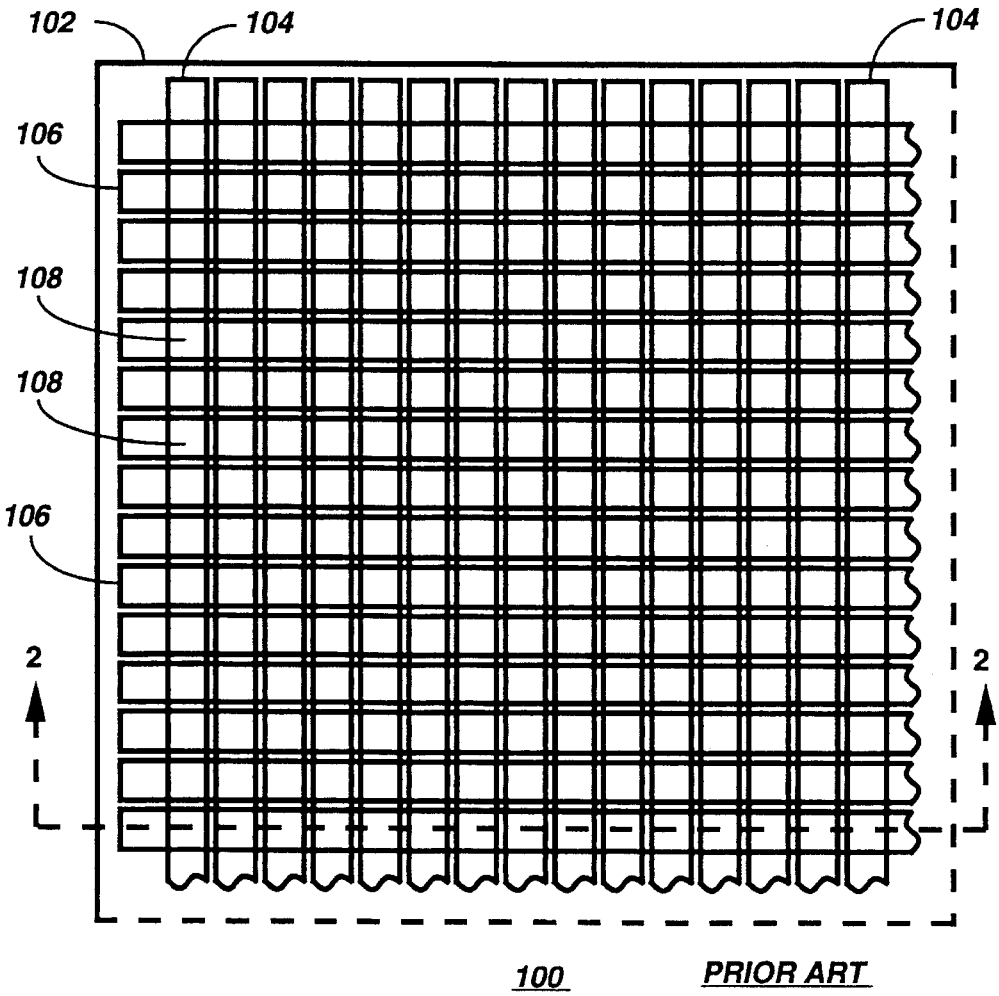
FIG. 1 is a front orthographic view of a portion of a conventional liquid crystal display.
Figure 2:
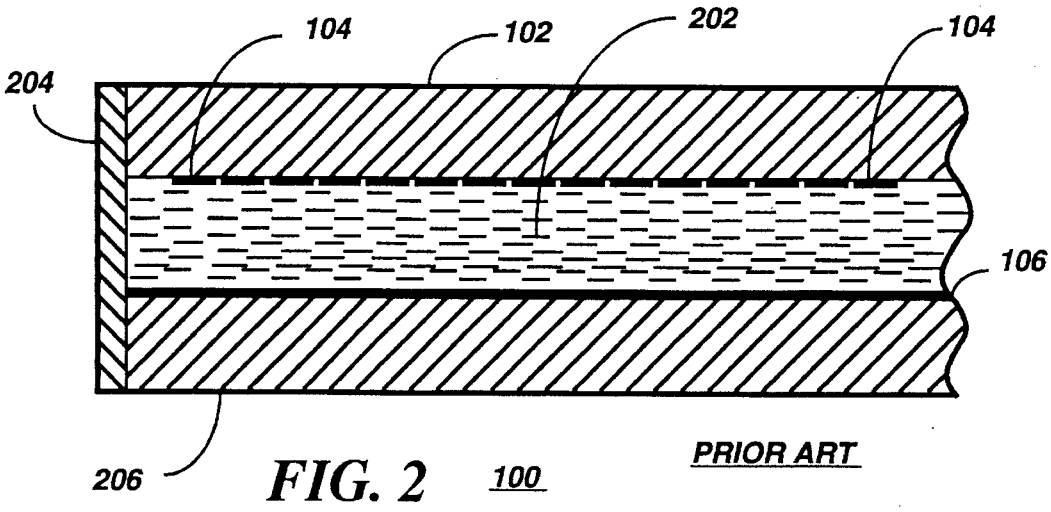
FIG. 2 is an orthographic cross-section view along the line 2—2 of FIG. 1 of the portion of the conventional liquid crystal display.

Referring to FIGS. 1 and 2, orthographic front and cross-section views of a portion of a conventional liquid crystal display (LCD) 100 depict first and second transparent substrates 102, 206 having a space therebetween filled with a layer of liquid crystal material 202. A perimeter seal 204 prevents the liquid crystal material from escaping from the LCD 100. The LCD 100 further includes a plurality of transparent electrodes, comprising row electrodes 106 positioned on the second transparent substrate 206, and column electrodes 104 positioned on the first transparent substrate 102. At each point at which a column electrode 104 overlaps a row electrode 106, such as the overlap 108, voltages applied to the overlapping electrodes 104, 106 can control the optical state of the liquid crystal material 202 therebetween, thus forming a controllable picture element (pixel). While an LCD is the preferred display element in accordance with the preferred embodiment of the present invention, it will be appreciated that other types of display elements may be used as well, provided that such other types of display elements exhibit an optical characteristics responsive to the square of the voltage applied to each pixel, similar to the rms response of an LCD.

Figures 3, 4:
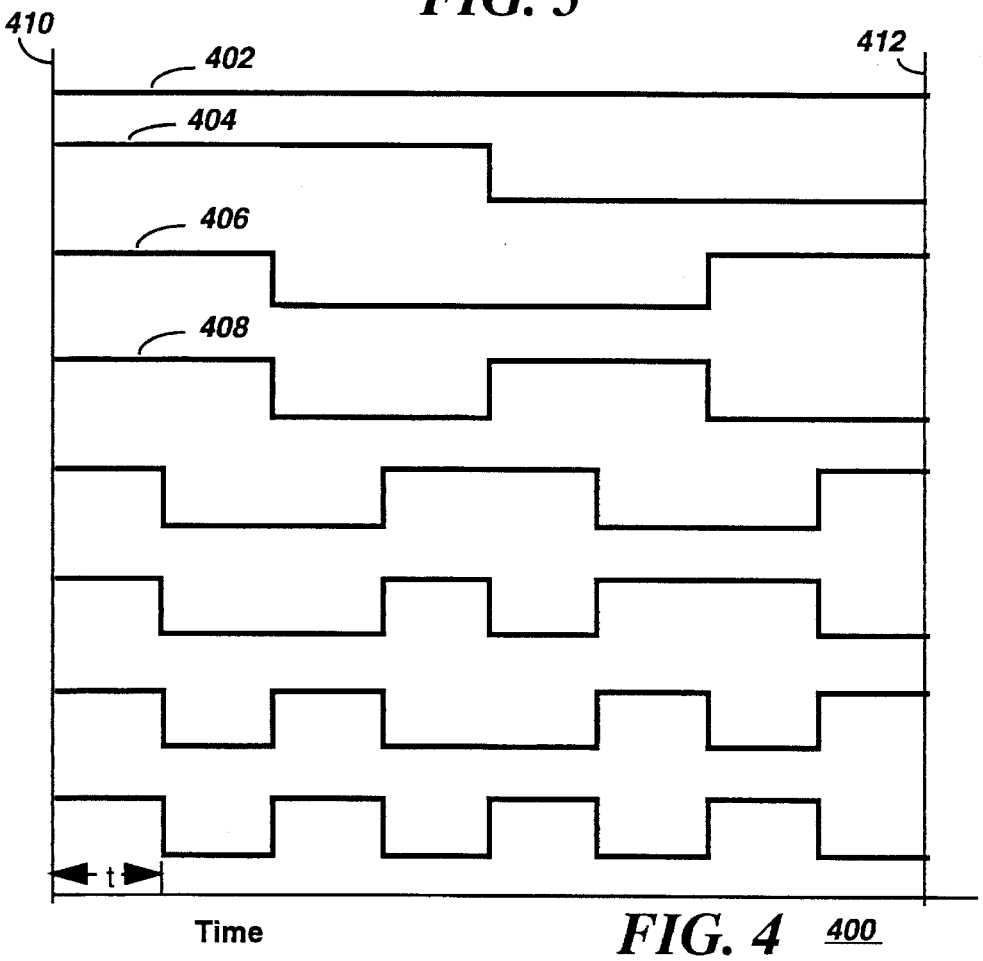
FIG. 3 is an eight-by-eight matrix of Walsh functions in accordance with the preferred embodiment of the present invention.
FIG. 4 depicts drive signals corresponding to the Walsh functions of FIG. 3 in accordance with the preferred embodiment of the present invention.

Referring to FIGS. 3 and 4, an eight-by-eight (third order) matrix of Walsh functions 300 and the corresponding Walsh waves 400 in accordance with the preferred embodiment of the present invention are shown. Walsh functions are orthonormal and are preferable for use in an actively addressed display system, as discussed in the Background of the Invention herein above. When used in such a display system, voltages having levels represented by the Walsh waves 400 are uniquely applied to a selected plurality of electrodes of the LCD 100. For example, the Walsh waves 404, 406, and 408 could be applied to the first (uppermost), second, and third row electrodes 106, respectively, and so on. In this manner each of the Walsh waves 400 would be applied uniquely to a corresponding one of the row electrodes 106. It is preferable not to use the Walsh wave 402 in an LCD application, because the Walsh wave 402 would bias the LCD with an undesirable DC voltage.

It is of interest to note that the values of the Walsh waves 400 are constant during each time slot T. The duration of the time slot T for the eight Walsh waves 400 is one-eighth of the duration of one complete cycle of Walsh waves 400 from start 410 to finish 412. When Walsh waves are used for actively addressing a display, the duration of one complete cycle of the Walsh waves 400 is set equal to the frame duration, i.e., the time to receive one complete set of data for controlling all the pixels 108 of the LCD 100.

The eight Walsh waves 400 are capable of uniquely driving up to eight row electrodes 106 (seven if the Walsh wave 402 is not used). It will be appreciated that a practical display has many more rows. For example, displays having four-hundred-eighty rows and six-hundred-forty columns are widely used today in laptop computers. Because Walsh function matrices are available in complete sets determined by powers of two, and because the orthonormality requirement does not allow more than one electrode to be driven from each Walsh wave, a five-hundred-twelve by five-hundred-twelve ($2^9 \times 2^9$) Walsh function matrix would be required to drive a display having four-hundred-eighty row electrodes 106. For this case the duration of the time slot T is 1/512 of the frame duration. Four-hundred-eighty Walsh waves would be used to drive the four-hundred-eighty row electrodes 106, while the remaining thirty-two would be unused, preferably including the first Walsh wave 402 having a DC bias.

Figure 5:
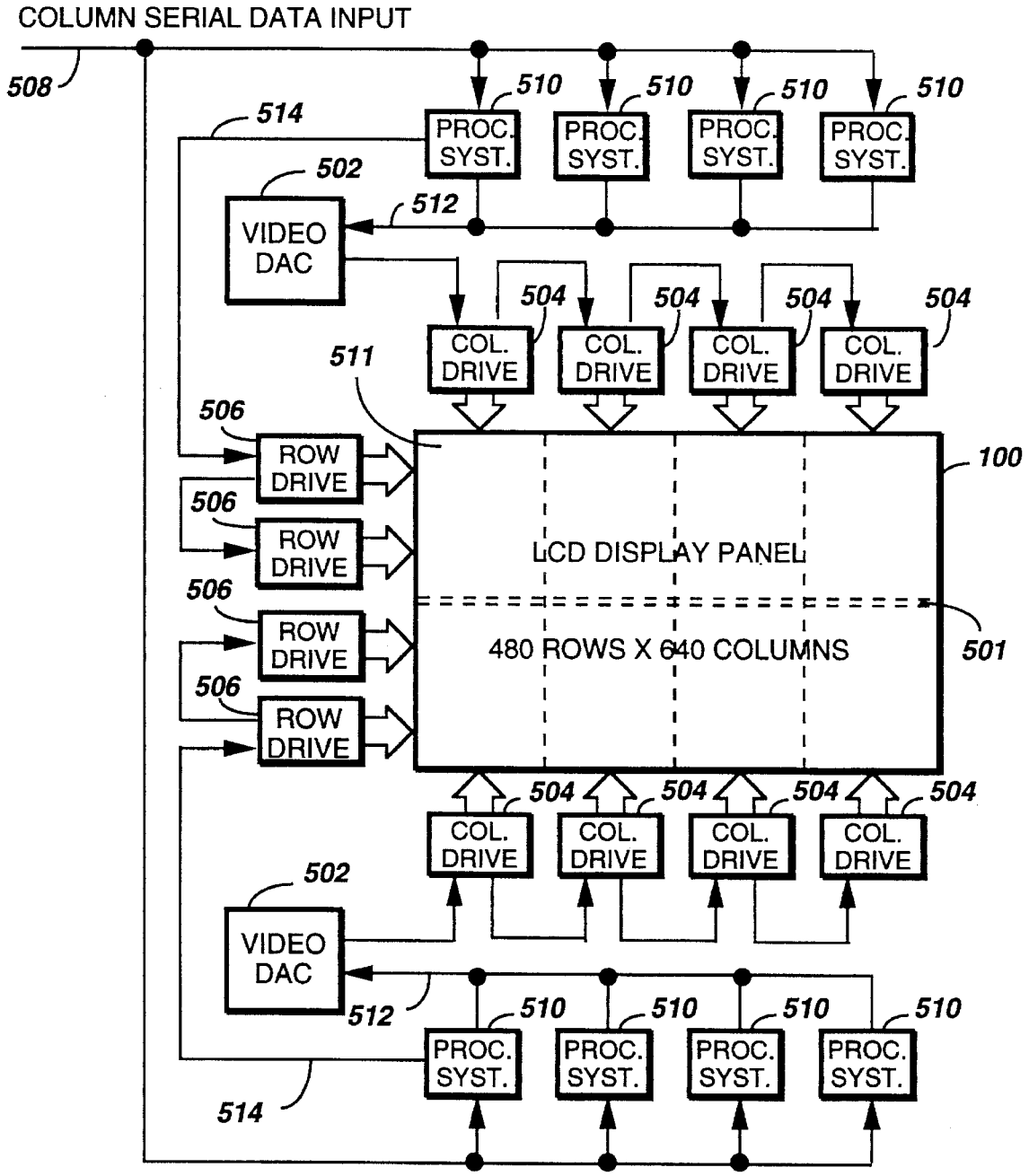
FIG. 5 is an electrical block diagram of a display system in accordance with the preferred embodiment of the present invention.

Referring to FIG. 5, an electrical block diagram of a display system 500 in accordance with the preferred embodiment of the present invention comprises a plurality of processing systems 510 coupled to a data input line 508, preferably eight bits wide, for receiving an input signal including successive frames of data to be displayed. The successive frames of data define image values, which are grouped into lines. The lines are vertical scans, or columns of image values, in accordance with the preferred embodiment of the present invention. The successive frames of data include six hundred forty of the lines, each consisting of four hundred eighty serially transmitted image values. The LCD 100 is of conventional design, having four hundred eighty row electrodes, hereafter referred to as first electrodes, extending horizontally across the LCD 100 and two sets of column electrodes, hereafter referred to as second electrodes. It will be appreciated that the lines of image values have a vertical, or column, direction which corresponds to the second set of electrodes. Each set of second (column) electrodes extends vertically from an edge (upper or lower) almost to the center of the display 501, each second (column) electrode thereby crossing one half of the first (row) electrodes. This conventional electrode organization reduces the amount of calculations performed by each processing system and improves the contrast and maximum frame rate of the display system for prior art active addressed displays, as well as in the display system 500 in accordance with the preferred embodiment of the present invention, in a simple and cost effective manner. This type of arrangement of the second display electrodes is referred hereinafter as split second electrodes. To reduce calculation requirements for each of the processing systems 510 the LCD 100 has been partitioned into eight areas 511, each serviced by one of the processing systems 510, and each containing one-hundred-sixty column electrodes 104 and two-hundred-forty row electrodes 106. It will be appreciated that the Walsh matrix necessary in the preferred embodiment of the present invention is of size $2^8 \times 2^8$ (256×256), and therefore the time slot, T, is 1/256th of a frame period.

The processing systems 510 are coupled by image dependent (column) output lines 512, preferably eight bits wide, to video digital-to-analog converters (DACs) 502, such as the model CXD1178Q DAC manufactured by Sony Corporation, for converting the digital output signals on the image dependent (column) output lines 512 into corresponding analog second (column) drive signals. The DACs 502 are coupled to second (column) drive elements 504 of an analog type, such as the model SED1779D0A driver manufactured by Seiko Epson Corporation, for driving the second (column) electrodes 104 of the LCD 100 with the analog second (column) drive signals. Two of the processing systems 510 are also coupled by image independent (row) output lines 514 to first (row) drive elements 506 of a digital type, such as the model SED1704 driver also manufactured by Seiko Epson Corporation, for driving the first (row) electrodes 106 of the upper and lower partitions of the LCD 100 with a predetermined set of Walsh signals. It will be appreciated that other similar components can be used as well for the DACs 502, the second (column) drive elements 504, and the first (row) drive elements 506.

The second (column) and first (row) drive elements 504, 506 receive and store a batch of drive level information intended for each of the second (column) and first (row) electrodes 104, 106 for the duration of the time slot T (FIG. 4). The second (column) and first (row) drive elements 504, 506 then substantially simultaneously apply and maintain the drive levels for each of the second (column) and first (row) electrodes 104, 106 in accordance with the received drive level information until a next batch, e.g., a batch corresponding to the next time slot T, is received by the second (column) and first (row) drive elements 504, 506. In this manner the transitions of the drive signals for all the second (column) and first (row) electrodes 104, 106 occur substantially in synchronism with one another.

Figure 6:
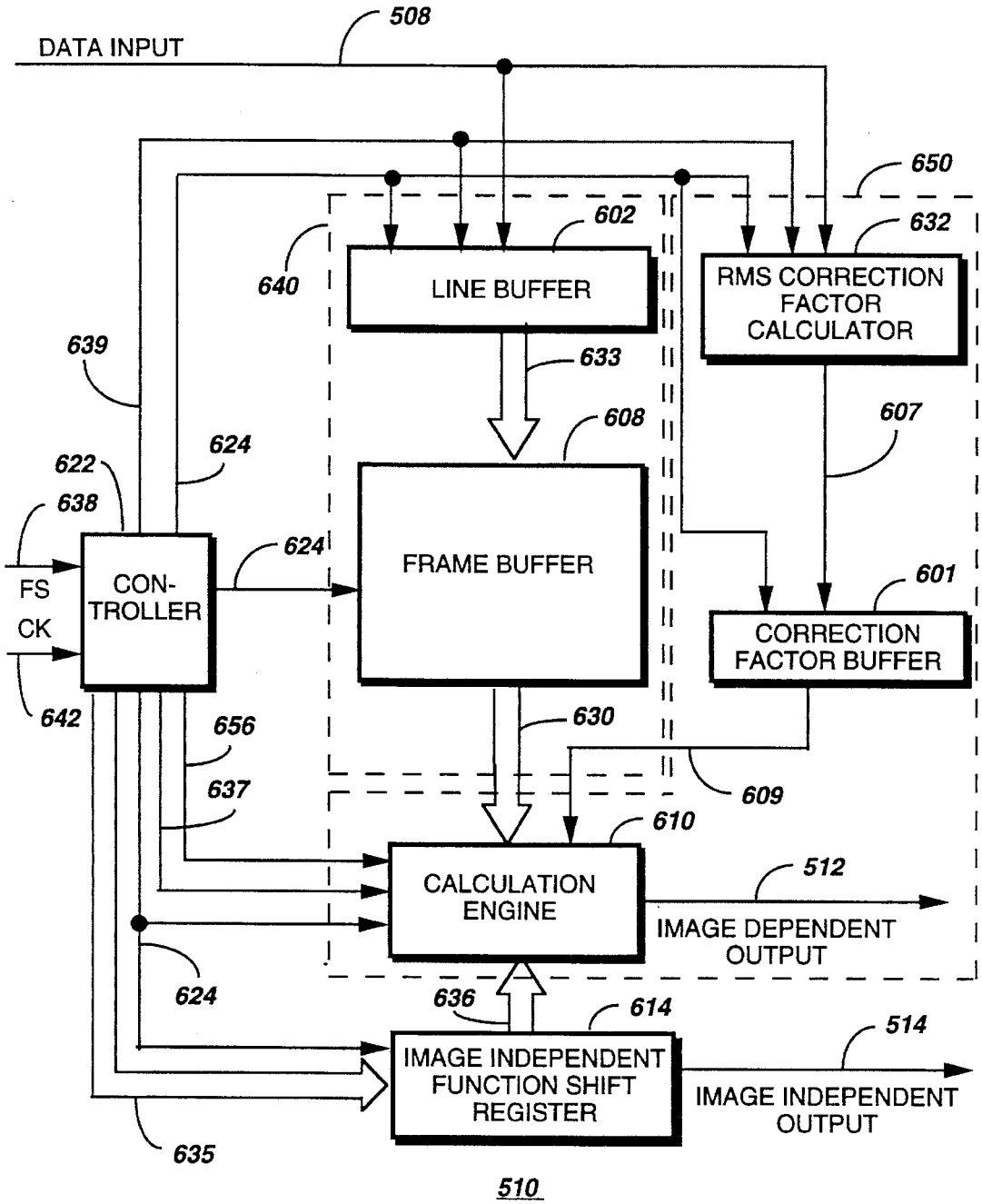
FIG. 6 is an electrical block diagram of a processing system of the display system in accordance with the preferred embodiment of the present invention.

Referring to FIG. 6, an electrical block diagram of one of the processing systems 510 of the display system in accordance with the preferred embodiment of the present invention comprises a controller 622, a video memory 640, an image dependent output calculator 650, and an image independent function shift register 614. The video memory 640 comprises a line buffer 602 and a frame buffer 608. The data input line 508 is coupled to the line buffer 602. The line buffer 602 is coupled to the controller 622 by a timing signal 639. The line buffer is for receiving two hundred forty serially transmitted image values from a single line of a frame of data, for storing the two hundred forty image values, and for outputting the two hundred forty image values on a parallel bus 633. It will be appreciated that the line buffer 602 is storing a portion of a single complete line of four hundred eighty image values because the processing system 500 is processing one block 511 of image values for the display 100, and thus may alternatively be referred to as a partial single line buffer 602. The timing signal 639 provides synchronization with the transmitted image values. The line buffer 602 comprises conventional input circuits, conventional counters, conventional random access memory (RAM), conventional control logic, and conventional shift register elements of sufficient, but not excessive, size inter coupled in a conventional manner to provide the described function of receiving, storing, and transferring a single line of image values. It will be appreciated that in some display systems 500 the input signal may be analog, in which event the display system 500 may also comprise an analog to digital converter for generating a digital signal which is coupled to the line buffer 602.

The parallel bus 633 couples the line buffer 602 to the frame buffer 608 for transferring the line of image values into the frame buffer 608 when a complete line of image values has been received and erasing a corresponding line of image values transferred into the frame buffer 608 from the previous frame of data. The parallel bus 633 is a two hundred forty by eight bit wide bus. The frame buffer 608 is a RAM having sufficient, but not excessive, storage locations to store one hundred sixty lines of two hundred forty image values comprised of conventional memory, input, output, and addressing elements, with the memory, addressing, input and output organized for conventional parallel input and output of the line of image values. It will be appreciated that the frame buffer 608 is storing a portion of a single complete frame of six hundred twenty lines because the processing system 500 is processing one block 511 of image values for the display 100, and thus the single frame memory 608 may alternatively be referred to as a partial single frame buffer 608.

The controller 622 is coupled by a control bus 624 to the line buffer 602 and the frame buffer 608 for controlling the operation of the line buffer 602 and the frame buffer 608. The controller 622 is further coupled by the control bus 624 to an image independent function shift register 614 for controlling the operation of the image independent function shift register 614. The controller 622 is coupled by an image independent function bus 635 for transferring fi predetermined image independent function generated by the controller 622 to the image independent function shift register 614. The image dependent output calculator 650 comprises an rms correction factor calculator 632, a correction factor buffer 601, and a calculation engine 610. The controller 622 is further coupled by the control bus 624, by a timing signal 637, and by a virtual value signal 656 to the calculation engine 610 for controlling the operation of the calculation engine 610. The controller 622 is also coupled by the control bus 624 to the rms correction factor calculator 632 for controlling the rms correction factor calculator 632, and by the timing signal 639 for providing image value synchronization with the input signal on the data input line 508. The rms correction factor calculator 632 is also coupled to the data input line 508 for receiving the lines of image values to determine a correction factor for each of the lines, as explained herein below in reference to FIG. 7. The correction factor buffer 601 is coupled to the rms correction factor calculator 632 by a first correction factor signal 607 for receiving and storing the correction factor determined by and sent from the rms correction factor calculator 632 for each line. The controller 622 is further coupled by control bus 624 to the correction factor buffer 601 for controlling the correction factor buffer 601. Each correction factor is stored for one frame period in the correction factor buffer 601 which stores one hundred sixty correction factors corresponding to the one hundred sixty most recently received lines of image values. The correction factor buffer 601 is coupled to the image independent function shift register 614 by a second correction factor signal 609 for transferring a correction factor to the calculation engine 610.

The image values within the frame buffer memory 608 are organized by the controller 622 into blocks, each block corresponding to substantially all the pixels 108 controlled by a single group of second electrodes 104, the group size determined in accordance with the present invention, and the second electrodes 104 falling within the area 511 serviced by the processing system 510. The block sizes are one hundred sixty lines of two hundred forty image values, as described above. The controller 622 controls the operation of the line buffer 602 and the frame buffer 608 to convert and store the image values for one predetermined block of the blocks in a frame of data. When a complete line of image values within the predetermined block is transmitted on data input line 508, the controller 622 controls the line buffer 602 to transfer the image values stored in the line buffer 602 to a predetermined line location in the frame buffer 608 corresponding to the line of image values transmitted.

The frame buffer memory 608 is coupled by a parallel data bus 630 to the calculation engines 610 for calculating values for driving the second electrodes 104 for each Walsh signal time slot T. The parallel data bus 630 is sufficiently wide to transmit simultaneously image values for substantially all the pixels 108 controlled by a single group of second electrodes 104 and falling within the area 511 of the LCD 100 serviced by the processing system 510. For example, in the processing system 510 servicing two-hundred-forty rows and having eight-bit pixel values, the parallel data bus 630 must have one-thousand-nine-hundred-twenty (1920) parallel paths.

The function of the image independent function shift register 614 is to receive from the controller 622 the Walsh function values corresponding to the first electrodes serviced by the processing system 510 for each time slot T. Having received the Walsh function values for the time slot T over the image independent function bus 635, the image independent function shift register 614 then transfers the received Walsh function values for the time slot T to the calculation engine 610 for use in calculating an image dependent signal for the time slot. The image independent function shift register 614 also drives the image independent output lines 514 at a rate controlled by the controller 622 in accordance with the preferred embodiment of the present invention with the Walsh function values corresponding to the first serviced by the processing system 510 for each time slot T. The image independent function shift register 614 is preferably a conventional two hundred forty by one bit serial input/parallel output shift register. The image independent function shift register 614 is simple enough that it could alternatively be incorporated into the controller 622, particularly in an embodiment using a high level of circuit integration.

The calculation engine 610 is coupled to the image independent function shift register 614 by parallel transfer bus 636 for transferring the Walsh function values to the calculation engine 610. The parallel transfer busses 636 must be sufficiently wide to transfer a one-bit Walsh function value for each first electrode serviced by the processing system 510. For example, in the processing system 510 servicing two-hundred-forty first electrodes, the parallel transfer bus 636 must have two-hundred-forty parallel paths. It will be appreciated that while Walsh functions are preferred, other orthonormal functions may be used as well by the calculation engine 610 to perform the calculations. The calculation engine 610 computes an image dependent signal having one hundred sixty values during each of the time slots. Each of the one hundred sixty values is used to drive one second electrode, and is determined from one line of image values stored in the frame buffer 608, one correction factor stored in the correction factor buffer 601, and the Walsh function (image independent function) for a time slot T. The correction factor is based on the corresponding one line of image values. Thus the calculation engine 610 makes one hundred sixty line image dependent value calculations during each time slot, each value dependent on only one line of image values. The structure and operation of the calculation engine 610 is described in greater detail herein below. The controller 622 controls the storage of each line of image value into the frame buffer 608 such that the storage of each line is performed between successive value calculations of two values of the image dependent signal and never during a line reading operation portion of a value calculation involving the corresponding line of image values, in which the corresponding line of image values is read from the frame buffer 608. The controller 622 is further coupled to the frame sync line 638 and to the clock line 642 for receiving frame sync and clock signals, respectively, from a source of the frames of data, e.g., a processor of a personal computer.

It will be appreciated that image values are stable while the calculation engine 610 is making an image dependent value calculation based on a line of image values, because the image line is stored between image value calculations. The memory and calculation architecture in accordance with the preferred embodiment of the present invention avoids image smearing and loss of contrast which would occur if image values were being updated in the direction orthogonal to the line direction. In prior art display systems, in which lines of image values are received as rows of image values and in which the image dependent signal is applied orthogonally to the column electrodes of the display, loss of contrast and smearing are avoided by using two full frame buffers, and reading from one frame buffer while writing to the second frame buffer. This is done in prior art display systems to avoid a change of image values which occurs when only one frame buffer is used in such prior art systems, due to incompatible "directions" of the lines of image values being received and the image values being read from the frame buffer to compute the image dependent signal values. The unique architecture described in accordance with the preferred embodiment of the present invention reduces the video memory requirements essentially to the line buffer 602 and the frame buffer 608, by storing the image values as a plurality of the lines in the frame buffer 608 and calculating an image dependent output signal having values each of which is dependent on one line of image values. The unique architecture described in accordance with the preferred embodiment of the present invention, which uses parallel line input and output for the single frame buffer 608 simplifies the interconnection of the video memory in comparison to prior art systems in which the inputs of the image values to the frame memories are in a direction orthogonal to the outputs of the image values from the frame memories.

Figure 7:
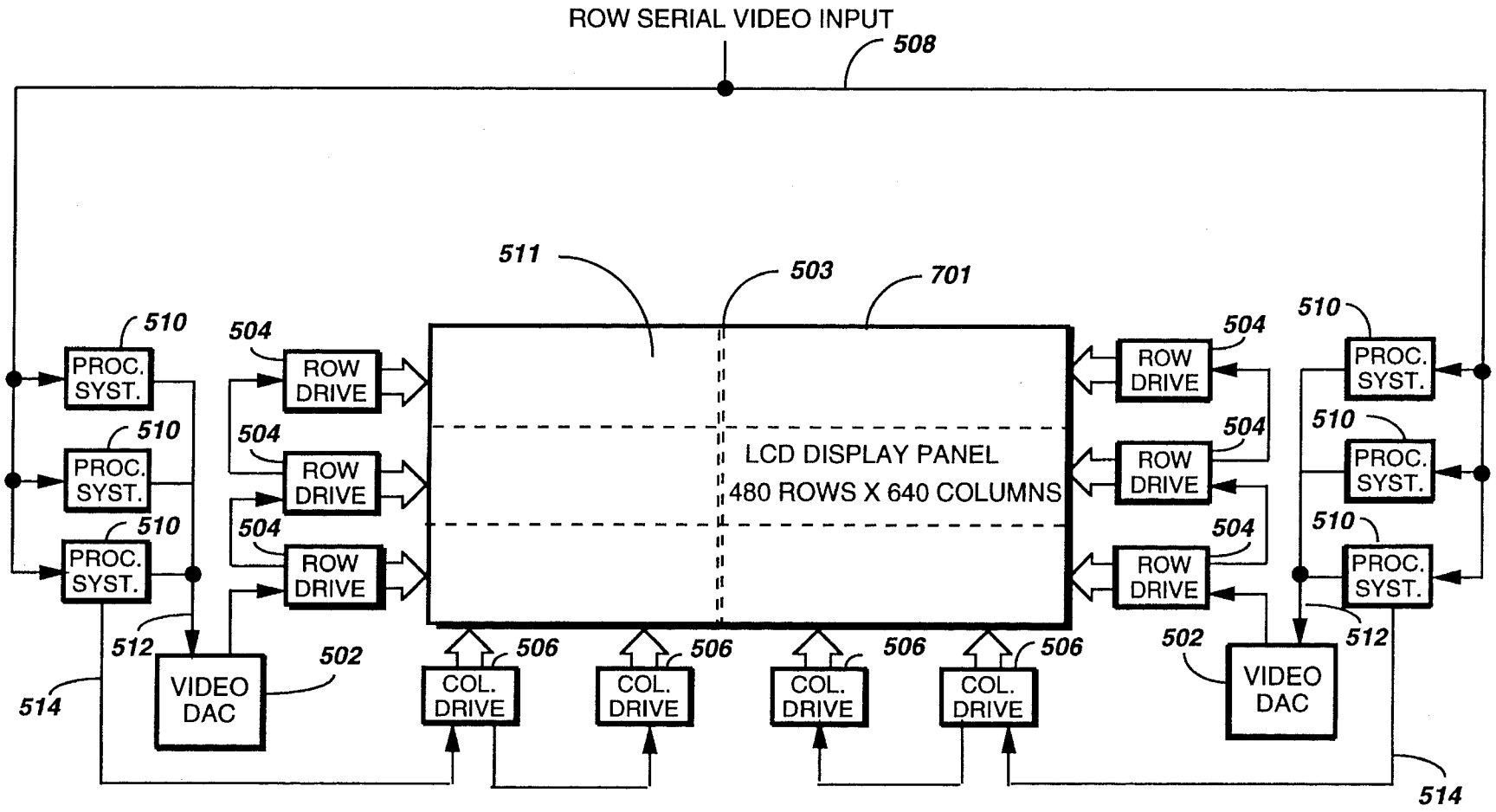
FIG. 7 is an electrical block diagram of a display system in accordance with a first alternate embodiment of the present invention.

Referring to FIG. 7, an electrical block diagram of a display system 700 in accordance with a first alternate embodiment of the present invention comprises a plurality of processing systems 510 coupled to a data input line 508, preferably eight bits wide, for receiving an input signal including successive frames of data to be displayed. The successive frames of data define image values, which are grouped into lines. The lines are horizontal scans, or rows of image values, in accordance with the first alternate embodiment of the present invention. The successive frames of data include four hundred eighty of the lines, each consisting of six hundred forty serially transmitted image values. The LCD 701 is fabricated using conventional display design and fabrication techniques, having six hundred forty column electrodes, hereafter referred to as first electrodes, extending vertically across the LCD 701 and two sets of row electrodes, hereafter referred to as second electrodes. It will be appreciated that the lines of image values have a horizontal, or row, direction which corresponds to the second set of electrodes. Each set of second (row) electrodes extends horizontally from an edge (left or right) almost to the center of the display 503, each second (row) electrode thereby crossing one half of the first (column) electrodes. This split second electrode organization reduces the amount of calculations performed by each processing system and improves the contrast and maximum frame rate of the display system 700 in a simple and cost effective manner. To reduce calculation requirements for each of the processing systems 510 the LCD 701 has been partitioned into six areas 711, each serviced by one of the processing systems 510, and each containing one hundred sixty row electrodes 106 and three hundred twenty column electrodes 104. It will be appreciated that the Walsh matrix necessary in the preferred embodiment of the present invention is of size $2^9 \times 2^9$ ($512 \times 512$), and therefore the time slot, T, is $1/512$th of a frame period.

The processing systems 510 are coupled by image dependent (row) output lines 512, preferably eight bits wide, to video digital-to-analog converters (DACs) 502, similar to the model CXD1178Q DAC manufactured by Sony Corporation, for converting the digital output signals of the processing systems 510 into corresponding analog second (row) drive signals. The DACs 502 are coupled to second (row) drive elements 504 of an analog type, such as the model SED1779D0A driver manufactured by Seiko Epson Corporation, for driving the second (row) electrodes 106 of the LCD 100 with the analog row drive signals. Two of the processing systems 510 are also coupled by first (column) output lines 514 to first (column) drive elements 506 of a digital type, similar to the model SED1704 driver also manufactured by Seiko Epson Corporation, for driving the first (column) electrodes 104 of the left and right partitions of the LCD 701 with a predetermined set of Walsh function signals. It will be appreciated that other similar components can be used as well for the DACs 502, the second (row) drive elements 504, and the first (column) drive elements 506.

The second (row) and first (column) drive elements 504, 506 receive and store a batch of drive level information intended for each of the second (row) and first (column) electrodes 106, 104 for the duration of the time slot T (FIG. 4). The second (row) and first (column) drive elements 504, 506 then substantially simultaneously apply and maintain the drive levels for each of the second (row) and first (column) electrodes 104, 106 in accordance with the received drive level information until a next batch, e.g., a batch corresponding to the next time slot T, is received by the second (row) and first (column) drive elements 504, 506. In this manner the transitions of the drive signals for all the second (row) and first (column) electrodes 104, 106 occur substantially in synchronism with one another.

It will be appreciated that the same processing system 510 described above with reference to FIG. 6 is usable for the display system 700, by modifying the size of devices and busses used in the processing system 510. The description remains the same in other aspects. The line buffer 602 is then a one hundred sixty image values by eight bit buffer, the frame buffer is then a one hundred sixty line by three hundred twenty image value by eight bit buffer, and the image independent function shift register 614 is then a three hundred twenty by one bit shift register. The parallel data bus 630 is then a one hundred sixty times eight, or one thousand two hundred eighty, bit wide bus, the parallel data bus 630 is then a three hundred twenty times eight, or two thousand five hundred sixty, bit wide bus, and the parallel data bus 636 is then a three hundred twenty bit wide bus. Similar size changes, which are needed within the rms correction factor calculator 632 and the calculation engine 610 in accordance with the first alternate embodiment of the present invention, are evident in the more detailed descriptions herein below to one of ordinary skill in the art.

It will be further appreciated that the display system 700 in accordance with the first alternate embodiment of the present invention may be a desirable design choice when a large (e.g., four hundred eighty row and six hundred forty column) display system is to be provided and the input signal does not provide and cannot be economically altered to provide image values in rows, instead of columns. An example is a case in which the equipment which produces the serial data signal already exists in large quantities and cannot be altered economically to produce a signal having image values in column format. When a smaller display system (e.g., two hundred forty row by three hundred twenty column) display system is involved, a split electrode display panel may not be required to achieve a desired frame rate and contrast ratio, allowing an selection of the first electrodes as either the row or column electrodes and thereby allowing the unique architecture described herein in accordance with the preferred and alternate embodiments of the present invention, in which each value of the image dependent signal is determined from only one line of image values and in which the image dependent signal is applied to the set of display electrodes corresponding to the direction of the lines of input data.

Figure 8:
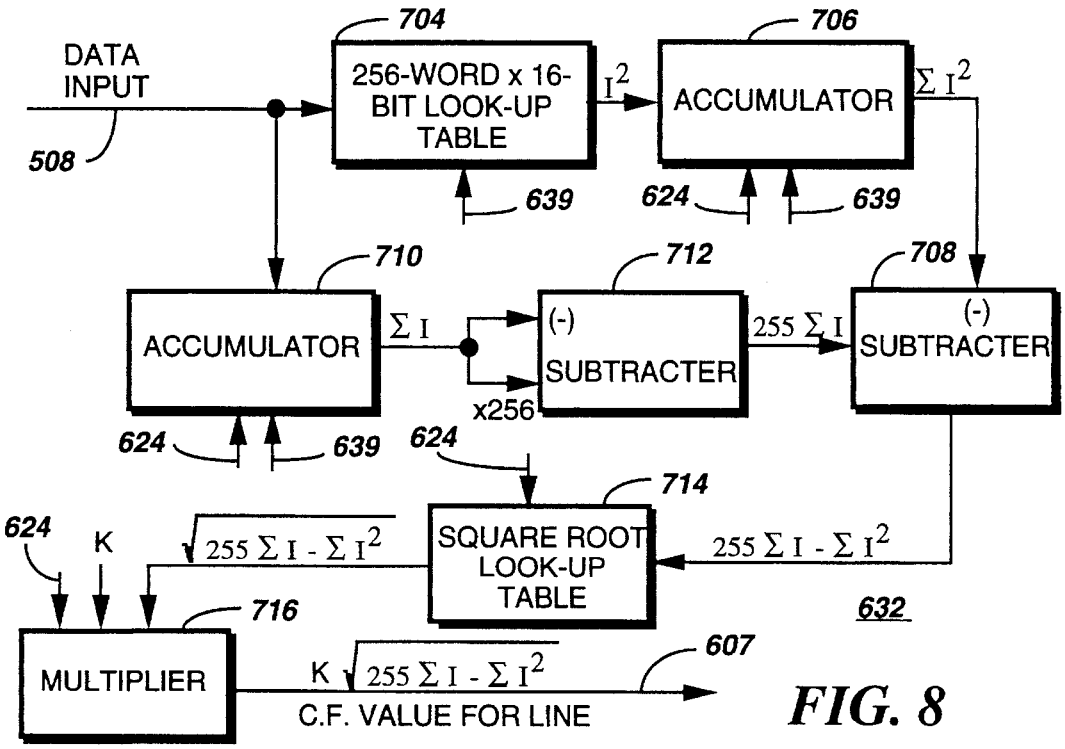
FIG. 8 is an electrical block diagram of an rms-correction factor calculator of the processing system in accordance with the preferred and alternate embodiments of the present invention.

Referring to FIG. 8, an electrical block diagram of the rms correction factor calculator 632 of the processing system 510 in accordance with the preferred and alternate embodiments of the present invention comprises the data input line 508, for receiving an input signal including successive frames of data to be displayed, the control bus 624, for controlling the rms correction factor calculator 632, and the timing signal 639. For a display using +1 to represent a fully "off" pixel and −1 to represent a fully "on" pixel, and using Walsh functions having values of only +1 and −1, the correction factor for each line of the display is $$\frac{1}{\sqrt{N}}\sqrt{N-\sum_{i=1}^{N} I_i^2}\ , \tag{1}$$

where N is the number of real first electrodes and $I_i$ is the value for the ith image value of the line.

Adjusting for eight-bit pixel values having a range of 0–255, and assuming there are two-hundred-forty real first electrodes, equation (1) becomes $$\frac{1}{\sqrt{240}}\sqrt{240-\sum_{i=1}^{240}\left(\frac{I_i-127.5}{127.5}\right)^2}\ , \tag{2}$$

which simplifies to $$\frac{1}{127.5\sqrt{240}}\sqrt{255\sum_{i=1}^{240} I_i-\sum_{i=1}^{240} I_i^2}\ , \tag{3}$$

which simplifies further to $$\frac{\sqrt{255\sum_{i=1}^{240} I_i-\sum_{i=1}^{240} I_i^2}}{1975}\ . \tag{4}$$

It is the function of the rms correction factor calculator 632 to calculate this correction factor for each line from the data arriving over the data input 508. The calculated rms correction factors, each of which corresponds to a line of image values, and also to one value of an image dependent signal (and thus also to one of the second electrodes), are transferred to the correction factor buffer 601 for temporary storage and subsequent transfer to the calculation engine 610. Within the calculation engine 610, each rms correction factor is combined with a summation of products of image an Walsh function values in accordance with conventional addressing techniques, as described herein below in reference to FIG. 9. The purpose of the rms correction factor is to eliminate a non-linear term that would otherwise enter into each image dependent signal value calculation, as can be proven by one of ordinary skill in the art of conventional active addressed displays.

The rms correction factor calculator 632 further comprises a first accumulator 710 coupled to the data input line 508 for summing the pixel values received. The output of the first accumulator 710 is coupled to both inputs of a first subtracter 712, wherein the minuend input data is first shifted eight bits to the left to multiply the minuend input data by two-hundred-fifty-six, thus producing an output value of 255 ΣI.

The data input line 508 is also coupled to the input of a first look-up table element 704 for determining the square of the pixel value. The output of the first look-up table element 704 is coupled to the input of a second accumulator 706 for summing the squares of the pixel values. The output of the second accumulator 706 is coupled to the subtrahend input of a second subtracter 708, to which the output of the first subtracter 712 is coupled at the minuend input for obtaining the difference 255 $\Sigma I-\Sigma I^2$. The output of the second subtracter 708 is coupled to a second look-up table element 714 for determining the square root value $\pm K\sqrt{255\Sigma I-\Sigma I^2}$.

The output of the second look-up table element 714 is coupled to an input of a multiplier element 716. The other input of the multiplier element 716 is preprogrammed for a constant value K. The value of K provides for the division factor of 1975 from equation (4), as well as any other drive level adjustments that may be required for the LCD 100. The output of the multiplier element 716 is coupled by the first correction factor signal 607 to the correction factor buffer 601 for storing the calculated correction factor. The timing signal 639 is coupled to the first look-up table element 704 and the accumulators 706, 710 for providing image value synchronization with the input signal on the data input line 508. The control bus 624 is coupled to the second look-up table element 714 and the multiplier element 716 for performing the multiplication operation when the complete line is received. The control bus 624 is further coupled to the first accumulator 706 and the second accumulator 710 for resetting the accumulated totals after a complete line is received. It will be appreciated that an arithmetic logic unit or a microcomputer can be substituted for some or all of the first and second look-up table elements 704, 714 and the multiplier element 716. It will be further appreciated that a microcomputer can also replace all the elements of the rms correction factor calculator 632.

Figure 9:
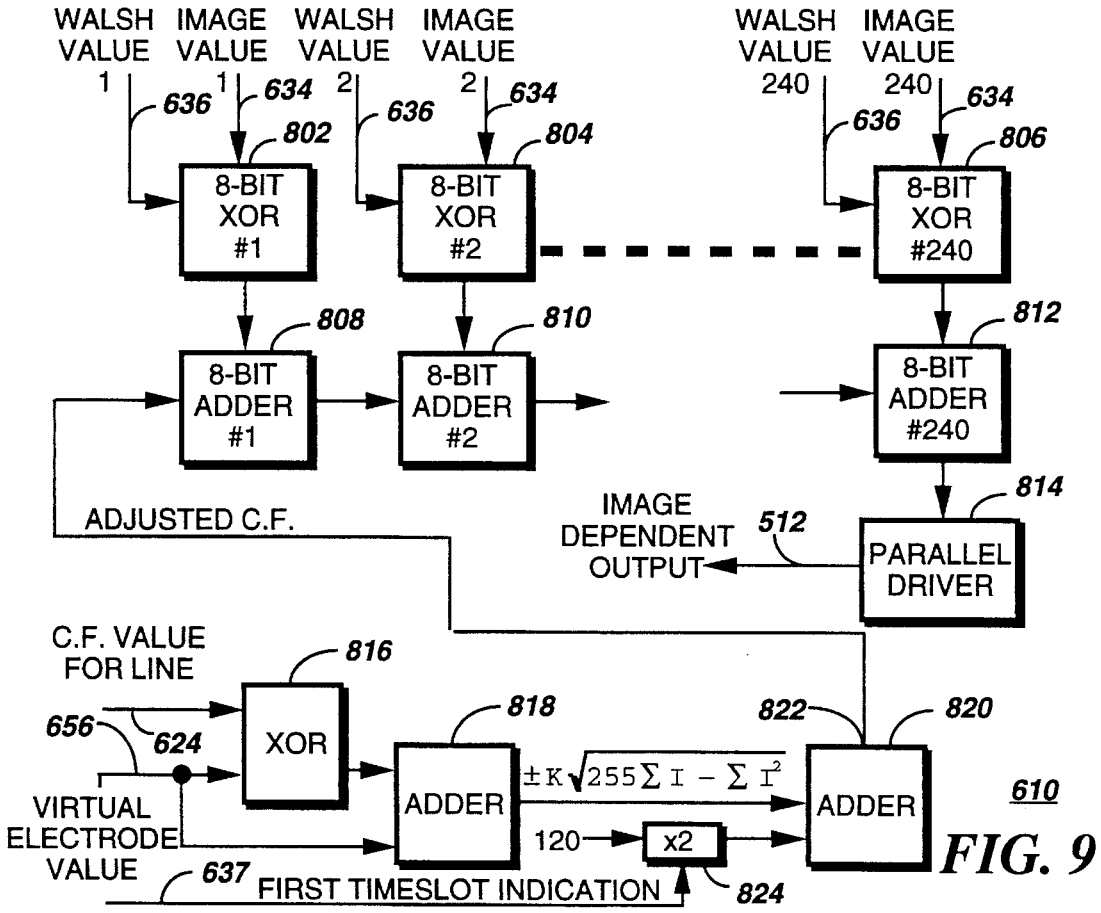
FIG. 9 is an electrical block diagram of a calculation engine of the processing system in accordance with the preferred and alternate embodiments of the present invention.

Referring to FIG. 9, an electrical block diagram of one of the calculation engines 610 of the processing system 510 in accordance with the preferred and alternate embodiments of the present invention comprises a plurality of 8-bit exclusive-OR (XOR) elements 802, 804, 806. The XOR elements 802, 804, 806 are coupled to the parallel data bus 630 for receiving pixel values from the frame memory 608 under the control of the controller 622. The XOR elements 802, 804, 806 are also coupled to the parallel transfer busses 636 for receiving Walsh function values from the image independent function shift register 614, also under the control of the controller 622. The function of the XOR elements 802, 804, 806 is to complement the bits of the pixel values whenever the corresponding Walsh function value is a logic ONE, and to leave the pixel value unchanged whenever the corresponding Walsh function value is a logic ZERO. A value of ONE must be added to each complemented pixel value (as explained herein below) in order to correctly subtract the pixel value from a sum being accumulated by the calculation engine 610.

The outputs of the XOR elements 802, 804, 806 are coupled to adder elements 808, 810, 812, which are coupled to each other, for generating a sum of the pixel values that have not been complemented by the XOR elements 802, 804, 806, and for subtracting from the sum the pixel values that have been complemented. The input of the first adder element 808 is coupled to the output 822 of a correction factor adjusting system, comprising elements 816, 818, 820 for adjusting the sign of the correction factor corresponding to the line being calculated in accordance with the Walsh function value for the time slot for a virtual first electrode designated for the correction factor calculations, and for adding the requisite value of ONE to each of the complemented pixel values. The output of the last adder element 812 is coupled to a parallel driver 814, preferably eight bits wide, for driving the image dependent output lines 512.

A correction factor adjusting system comprises an XOR element 816 coupled to the controller 622 by the second correction factor signal 609 for receiving the correction factor for the line, as stored previously by the correction factor buffer 601, and for receiving over the virtual value signal 656 the value of the Walsh function for the time slot for the virtual first electrode. The output of the XOR element 816 is coupled to an input of an adder element 818. The other input of the adder element 818 is coupled to the virtual value signal 656. The function of the XOR element 816 and the adder element 818 so coupled is to cause the sign of the correction factor value to be negative whenever the virtual value is a logic ONE, and positive whenever the virtual value is a logic ZERO. The output of the adder 818 is coupled to an input of an adder 820. The other input of the adder 820 is preprogrammed for a constant value of one-hundred-twenty for all time slots except the first, for which the adder 820 is preprogrammed for a value of two-hundred-forty. This is accomplished by shifting the preprogrammed value of one-hundred-twenty by one bit to the left whenever the x2 element 824 is enabled at the first time slot by the timing signal 637 from the controller 622.

The reason for adding the constant values is to accomplish the requisite addition of ONE to each complemented pixel value. The predetermined Walsh factors for the two-hundred-forty real first electrodes have exactly one-hundred-twenty logic ONEs in every time slot except the first time slot, which has two-hundred-forty logic ONEs. This means that for every time slot except the first there will be one-hundred-twenty pixel values complemented by the XOR elements 802, 804, 806 of the calculation engine 610. For the first time slot, all two-hundred-forty pixel values will be complemented. As indicated herein above, a value of ONE must be added to each of the complemented pixel values in order to correctly subtract the pixel values from the sum. The adder 820 and the x2 element 824 accomplish this.

Figure 10:
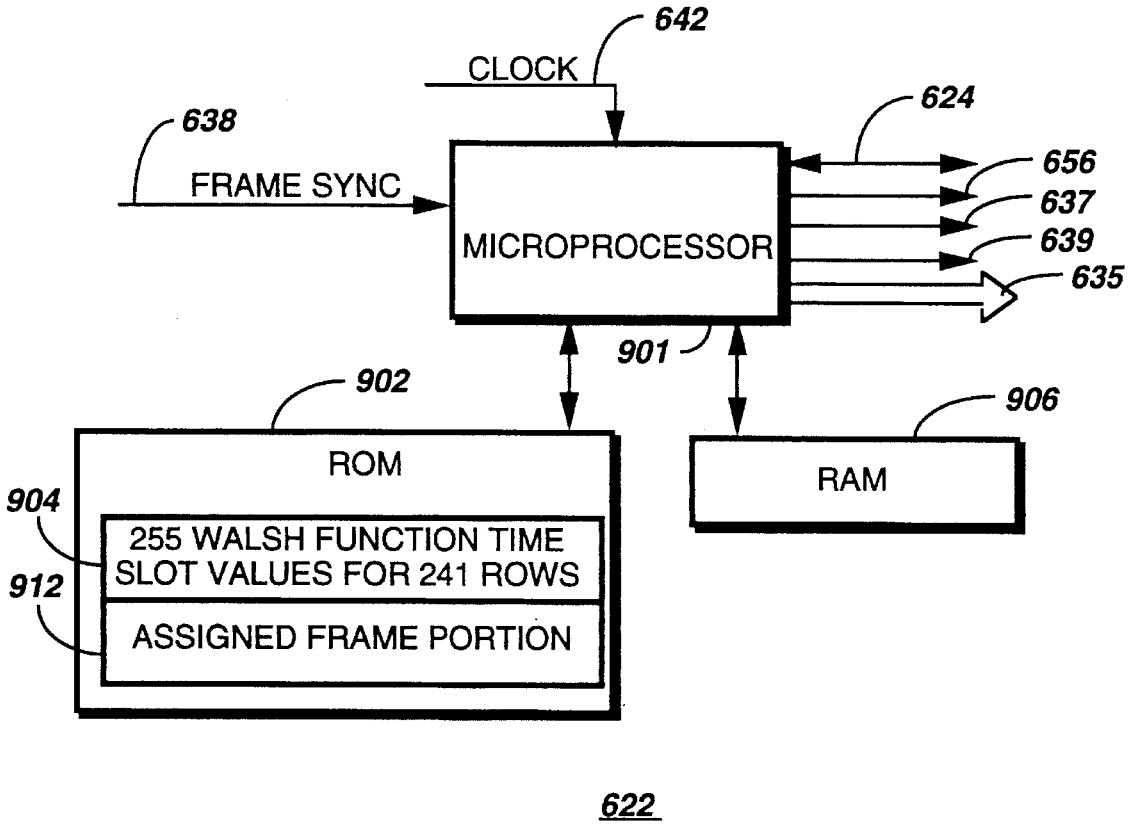
FIG. 10 is an electrical block diagram of a controller of the processing system in accordance with the preferred and alternate embodiments of the present invention.

Referring to FIG. 10, an electrical block diagram of the controller 622 of the processing system 510 in accordance with the preferred and alternate embodiments of the present invention comprises a microprocessor 901 coupled to a read-only memory (ROM) 902 containing operating system software and a random access memory (RAM) 906 for storing values of variables used by the operating system software. The ROM 902 further contains predetermined Walsh function values 904, e.g., two-hundred-fifty-six time slot values for each of the two-hundred-forty real first electrodes 106, plus one virtual first electrode. The ROM 902 also has been pre-programmed with an assigned frame portion value 912 indicating the portion, or block, of the frame of data, i.e., the portion 511 of the display, that the processing system 510 comprising the controller 622 is assigned to process. The microprocessor 901 is coupled to the processing system 510 by the control bus 624, the virtual value signal 656, the timing signal 637, the frame sync signal 638, and the image independent function bus 635 for controlling the processing system 510.

Figure 11:
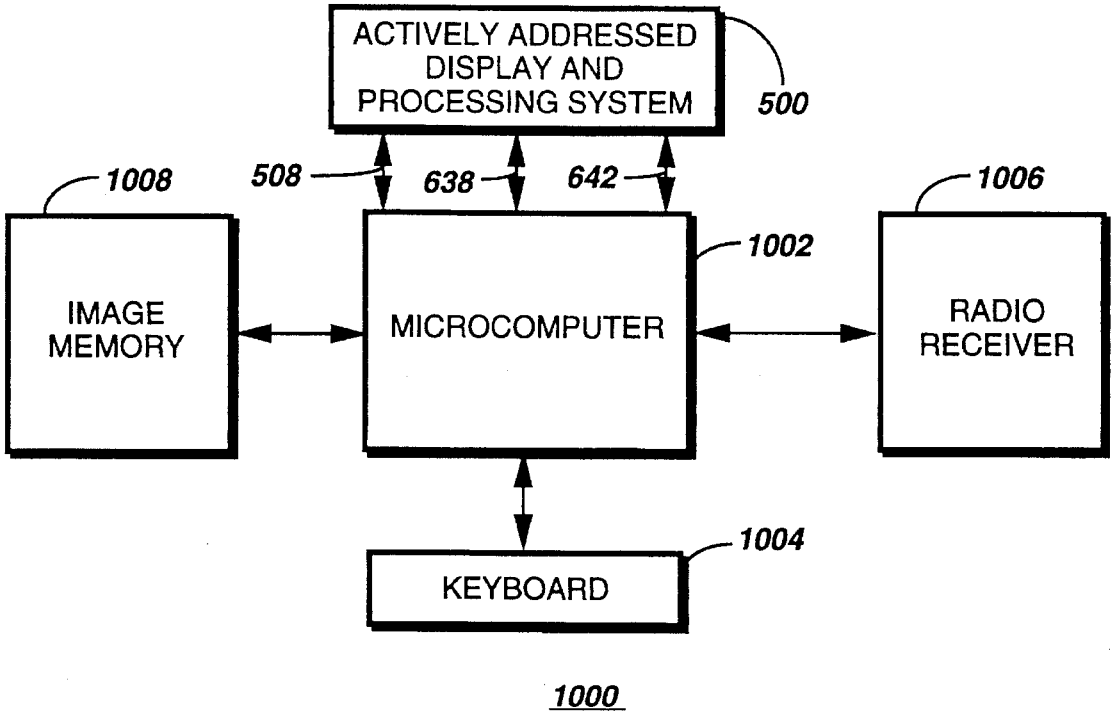
FIG. 11 is an electrical block diagram of a personal computer in accordance with the preferred and alternate embodiments of the present invention.

Referring to FIG. 11, an electrical block diagram of a personal computer 1000 in accordance with the preferred and alternate embodiments of the present invention comprises the display system 500 coupled to a microcomputer 1002 by the data input line 508 for receiving frames of data transmitted by the microcomputer 1002. Each frame of data defines a plurality of successively transmitted lines of image values. The display system 500 is further coupled to the microcomputer 1002 by the frame sync line 638 and the clock line 642 for receiving frame sync and clock, from the microcomputer 1002. The microcomputer 1002 is coupled to a keyboard 1004 for receiving input from a user. The microcomputer 1002 is coupled to a radio receiver 1006 for receiving a video image signal from a radio transmitter and an image memory 1008 for storing a virtual image. The input signal on input line 508 is derived from a radio signal received by the radio receiver 1006. Alternatively, the input signal on input line 508 can be derived from the image memory 1008, the contents of which are manipulated by a user using the keyboard 1004.

Figure 12:
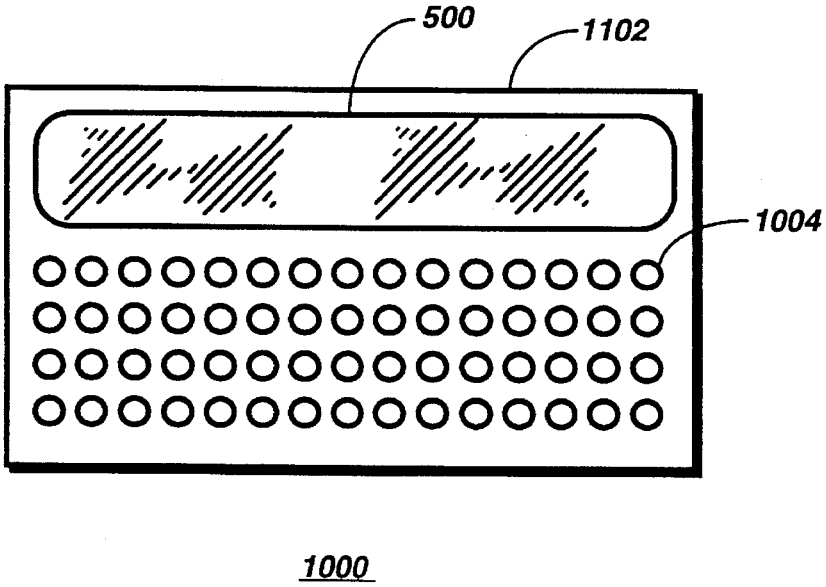
FIG. 12 is a front orthographic view of the personal computer in accordance with the preferred and alternate embodiments of the present invention.

Referring to FIG. 12, a front orthographic view of the personal computer 1000 in accordance with the preferred and alternate embodiments of the present invention depicts the display system 500 supported and protected by a housing 1102. The keyboard 1004 is also depicted. Personal computers, such as the personal computer 1000, often are constructed as portable, battery-powered units. The display system 500 is particularly advantageous in such battery-powered units, because the reduced memory requirement of the processing system 510 of the display system 500 compared to conventional processing systems for actively addressed displays greatly reduces the size of the electronic circuit, and also reduces the power consumption, thus extending the battery life.

System operation is such that when frame sync is received on frame sync line 638, each controller 622 of the plurality of processing systems 510 determines from the assigned frame portion value 912 which portion, or block of the frame of data the processing system 510 that comprises the controller 622 is assigned to process, corresponding to the block 511 of the LCD 100. The controller 622 then delays the start of processing by the corresponding processing system 510 until the frame of data reaches the assigned block.

A method for use in the electronic device 1000 which processes a input signal to generate an image on an active addressed display 100 is described herein below, with respect to FIGS. 13–15. For the purpose of discussing the method of operation of the display system 500 used in the electronic device, the term "processor" as used herein below refers to one of the plurality of processing systems 510, and the term "line" refers to a partial or complete line of image values which is within an assigned block 511, 711 of the frame of data. Thus a line is a partial or complete line of image values, depending on the configuration of the blocks 511, 711.

Figure 13:
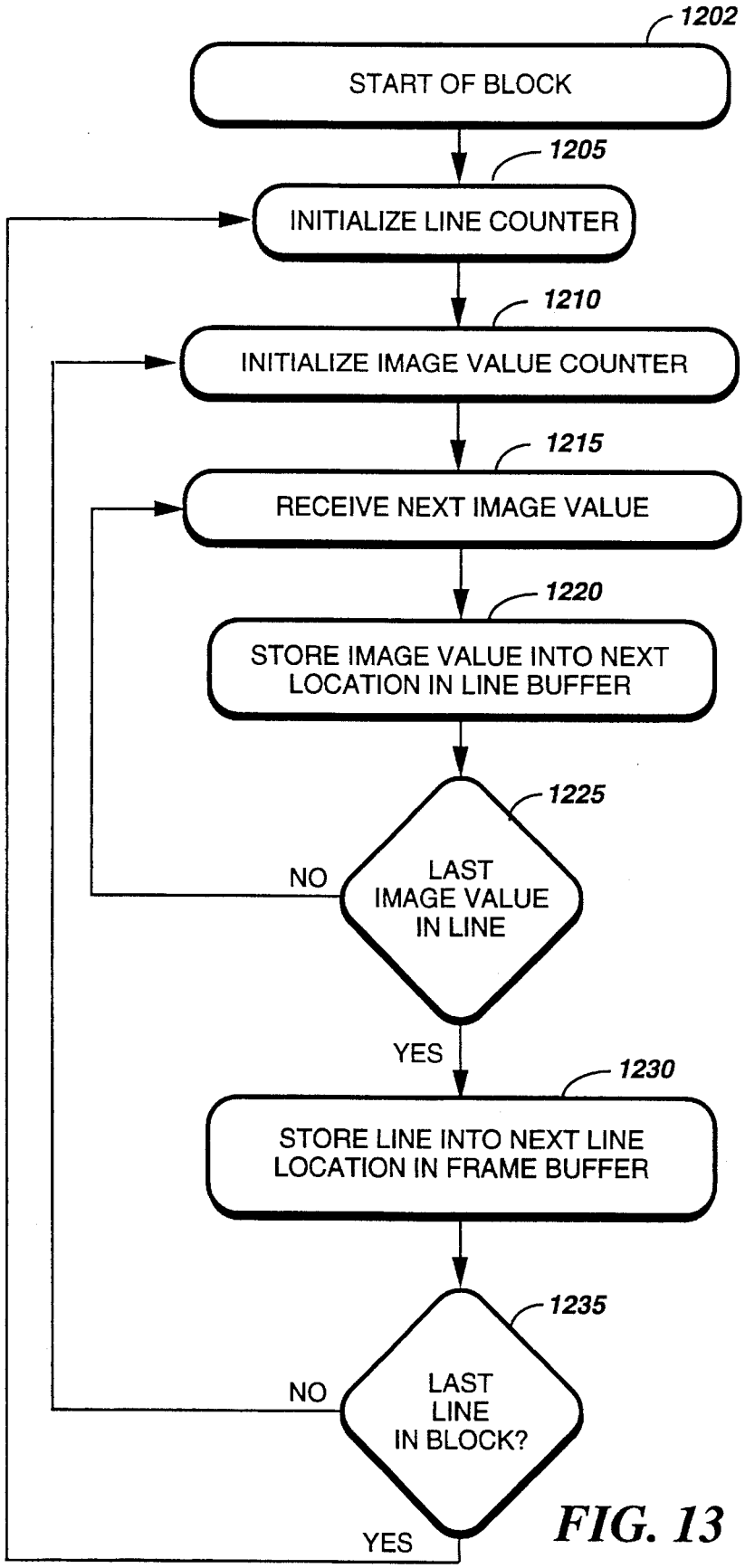
FIG. 13 is a flow chart depicting the operation of loading the video memory in accordance with the preferred and first alternate embodiments of the present invention.

Referring to FIG. 13, a flow chart depicting the operation of loading the video memory 640 in accordance with the preferred and first alternate embodiments of the present invention begins with the controller 622 of the processor waiting for the start of the block within a frame of data. When a start of block is determined, at step 1202, the controller 622 initializes a line counter at step 1205 and a image value counter at step 1210. At step 1215, the next image value is received. The image value is stored into a next location in the line buffer 602 at step 1220. When the image value is not the last image value in the line at step 1225, the operation continues at step 1215. When the image value is the last image value in the line at step 1225, the line is stored in the next line location in the frame buffer 608 at step 1230, erasing a corresponding line of image values stored therein from the previous frame of data. The controller 622 controls the storage of the line into the frame buffer 608 at step 1230 so that the storage does not take place while the corresponding line of image values is being read from the frame buffer 608 by the calculation engine 610 at step 1408 (FIG. 15). When the line is not the last line in the block at step 1235, the operation continues at step 1210. When the line is the last line in the block at step 1235, the operation continues at step 1205. In summary, lines of image values corresponding to a block of lines within a frame are stored into corresponding locations in the frame buffer memory 608 as they are received. It will be appreciated that controlling the line storage at step 1230 to not occur while the corresponding line is being read from the frame buffer 608 avoids loss of image contrast and image smearing.

Referring to FIG. 14, a flow chart depicting the operation of the rms correction factor calculator 632 in accordance with the preferred embodiment of the present invention begins with the controller 622 waiting for the start of the block within a frame of data corresponding to the area 511 of the LCD 100 assigned to the controller 622. When the start of the block is determined at step 1302, the first and second accumulator elements 710, 706 are initialized at step 1304 to zero by the controller 622. Next, the first look-up table element 704 squares the image value at step 1310, and the squared image value is then added at step 1314 to the second accumulator element 706 to derive $\Sigma I^2$. Concurrently, the image value is added at step 1312 to the first accumulator element 710 to derive $\Sigma I$. When all the image values for the line being calculated have not been received in step 1316, the operation continues at step 1306 to receive a next image value.

When all the image values for the line being calculated have been received, in step 1316, then $\Sigma I$ is multiplied by two-hundred-fifty-five at step 1318, as described herein above in the discussion of FIG. 8. Next, $\Sigma I^2$ is subtracted at step 1320 from the value obtained at step 1318, the subtraction being done by the second subtracter element 708. Then the square root of the value obtained at step 1320 is determined at step 1322 by the second look-up table element. The value determined at step 1322 is then multiplied at step 1323 by the constant K in the multiplier element 716. Next, the correction factor value for the line ($K\sqrt{255\Sigma I-\Sigma I^2}$) is transmitted from the rms correction factor calculator 632 to the correction factor buffer 601 and stored, at step 1324, in the correction factor buffer 601 at the location corresponding to the calculated line.

When, at step 1326, the controller 622 determines that the calculated line is not the last line assigned to the processing system 510, the controller 622 initializes the rms correction factor calculator 632 at step 1304 to begin processing the next line of data. When the controller 622 determines that the calculated line is the last line assigned to the processing system 510, the controller 622 waits for the next block to arrive at step 1302.

Figure 15:
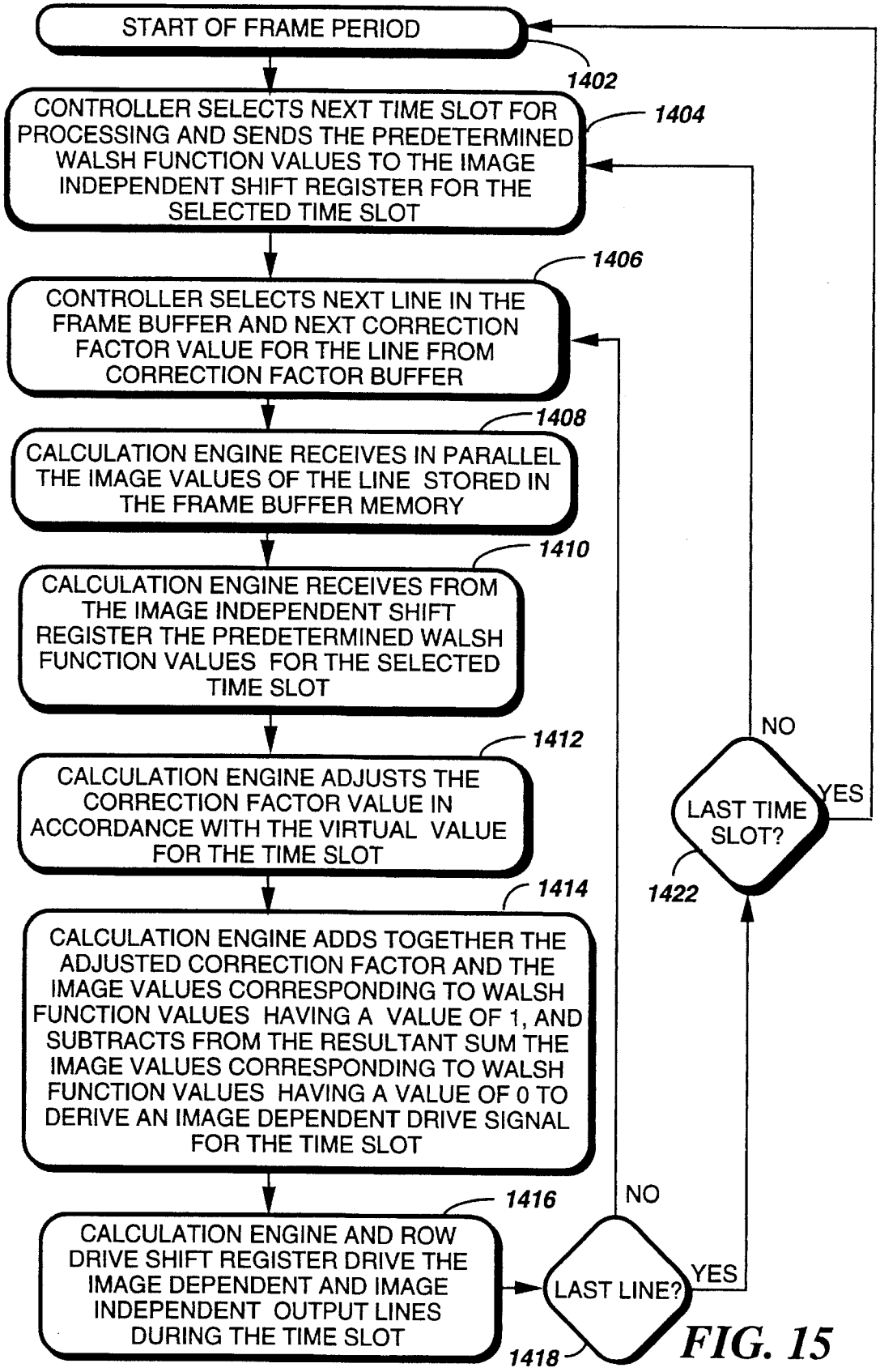
FIG. 15 is a flow chart depicting the operation of the calculation engine in accordance with the preferred and alternate embodiments of the present invention.

Referring to FIG. 15, a flow chart depicting the operation of the calculation engine 610 in accordance with the preferred embodiment of the present invention begins with the controller 622 waiting for a start of the next frame of data. When the start of the next frame of data is determined at step 1402, the controller 622 selects a next time slot for processing and initializes the image independent function shift register 614 with Walsh function values for the time slot for each of the first electrodes assigned to the controller 622, plus the virtual electrode, e.g., two-hundred-forty-one Walsh function values for the time slot, at step 1404.

At step 1406 the controller 622 then selects a next line for transfer from the frame buffer 608 to the calculation engine 610 and selects a correction factor corresponding to the selected line and transfers the correction factor from the correction factor buffer 601 to the calculation engine 610. Next, the controller 622 controls the frame buffer RAM 608 to transfer in parallel at step 1408 the two hundred forty image values of the selected line to the calculation engine 610. Concurrently, the calculation engine 610 receives, at step 1410, from the image independent function shift register 614 the Walsh function values for the time slot for each of the first electrodes assigned to the controller 622. The calculation engine 610 adjusts the correction factor value at step 1412 in accordance with the virtual first electrode drive signal for the selected line and the selected time slot, the adjustment made as described herein above in reference to FIG. 9.

Next, at step 1414, the calculation engine 610 derives an image dependent output signal by adding together the adjusted correction factor value and the image values of the selected line corresponding to real first electrodes having a Walsh function value of ONE, and subtracting from that sum the image values of the line corresponding to real rows having a Walsh function value of ZERO. Then at step 1416 the calculation engine 610 and image independent function shift register 614 drive the image dependent and image independent output lines 512, 514 during the time slot with the (calculated) image dependent and (predetermined) image independent signals, respectively.

It is important to note that the steps 1406, 1408, 1410, 1412, and 1414 are preferably performed substantially simultaneously and in parallel to achieve optimum calculation speed. Also, as was discussed herein above in reference to FIG. 5, in the preferred embodiment of the present invention only two of the processing systems 510 are used to drive the first drive elements 506. It will be appreciated that even a single processing system 510 is sufficient to drive the first drive elements 506, because the image independent signals for corresponding first electrodes in each of the group of two-hundred-forty first electrodes in the top and bottom halves of the LCD 100 are predetermined.

In step 1418 the controller 622 checks whether the last line has been processed for, the selected time slot. When the last line has not been processed for the selected time slot, the flow returns to step 1406 to select and process a next line. When the last column has been processed for the selected time slot at step 1418, the controller 622 checks at step 1422 whether the last time slot for the frame of data has been processed. When the last time slot for the frame has not been processed, the operation continues at step 1404, where the controller 622 selects a next time slot for processing. When the last time slot for the frame of data has been processed at step 1422, operation continues at step 1402, where the controller 622 will wait to start processing a next frame of data.

Thus, in the preferred and first alternate embodiments of the present invention, the video memory consists essentially of a single line buffer and a single frame buffer. Other logic may be needed in the video memory for such functions as input and output, but no significant additional image value memory is required. An insignificant amount of additional memory, such as storage for one image value, may be in the video memory of the preferred and first alternative embodiments of the present invention, for example, to simplify the buffering of one image value.

The preceding discussion and analysis of the preferred embodiment of the present invention applies to image values represented by eight-bit data. It will be appreciated that the present invention can be adjusted to accommodate image values represented by both larger and smaller numbers of bits, e.g., sixteen-bit or four-bit image values.

Thus, the preferred and alternate embodiments of the present invention provide a method and apparatus for driving an actively addressed display in a manner that advantageously minimizes the memory size and power consumption of the required calculation engine. By calculating each value of the of image dependent signal based on one line of image values and driving the second electrodes with the image dependent signal, the preferred and alternate embodiments of the of the present invention substantially reduce the amount of image value memory required, simplify the memory interconnections required, reduce the required calculation speed, and thus substantially reduce the power required to perform the calculations. The reduced memory size and power compared to conventional display processors for actively addressed displays is a particularly important advantage in portable, battery-powered applications, such as laptop computers, in which size and long battery life are highly desirable features.

What is claimed is:

1. A display system which processes an input signal to generate an image, the input signal including successive frames of data, wherein each of the successive frames of data defines a plurality of successively transmitted lines of image values, wherein the plurality of successively transmitted lines have a line direction, the display system comprising:

an active addressed display for displaying the image, wherein the active addressed display has a plurality of first electrodes and a plurality of second electrodes which cross each other at intersection points forming pixels, and wherein the plurality of second electrodes are in a direction corresponding to the line direction;

a video memory comprising:

a single line buffer, coupled to said input signal, for accumulating a stored line comprising one of the plurality of successively transmitted lines of image values; and a single frame buffer, coupled to said single line buffer, for storing a frame of data comprising a plurality of the stored lines;

a controller, coupled to said video memory, wherein said controller transfers the stored line from said single line buffer into said single frame buffer after the stored line is completely stored in said single line buffer and generates a predetermined image independent function having at least M values during a time slot;

a calculation engine, coupled to, said controller and said video memory, wherein said calculation engine computes an image dependent output signal during the time slot, and wherein the image dependent output signal has N values, and wherein each of said N values is determined from the predetermined image independent function and one of N sets of image values, and wherein said calculation engine reads each of the N sets of image values from a different one of the plurality of the stored lines stored in said single frame buffer;

a first driver element, coupled to said controller and said active addressed display, wherein during the time slot said first driver element generates M first voltages which are coupled to M first electrodes, and wherein each of the M first voltages is proportional to one of said at least M values; and a second driver element, coupled to said calculation engine and said active addressed display, wherein during the time slot said second driver element generates N second voltages which are coupled to N second electrodes, and wherein each of the N second voltages is proportional to one of said N values.

2. The display system according to claim 1, wherein said controller transfers the stored line into said single frame buffer while said calculation engine is not reading one of the N sets of image values from one of the plurality of the stored lines stored in said frame buffer which corresponds to the stored line stored in said single line buffer.

3. The display system of claim 1, wherein said single line buffer comprises a partial single line buffer for storing a predetermined portion of one of the plurality of successively transmitted lines of image values.

4. The display system of claim 1, wherein said single frame buffer comprises a partial single frame buffer for storing a predetermined portion of the plurality of successively transmitted lines of image values.

5. The display system of claim 1, wherein M and N are predetermined positive integers, and wherein a total duration of P time slots is substantially equivalent to a duration of one of the successive frames of data, and wherein P is an integral power of 2, and wherein P is greater than M.

6. The display system according to claim 1, wherein the predetermined image independent function is one of a plurality of orthonormal predetermined image independent functions, and wherein each of said N values has one of a group of values consisting of −1 and +1.

7. A display system which processes an input signal to generate an image, the input signal including successive frames of data, wherein each of the successive frames defines a plurality of successively transmitted columns of image values, the display system comprising:

an active addressed display for displaying the image, wherein the active addressed display has a plurality of row electrodes and a plurality of column electrodes which cross each other at intersection points forming pixels;

a video memory, comprising:

a single column buffer, coupled to said input signal, for accumulating a stored column comprising one of the plurality of successively transmitted columns of image values; and a single frame buffer, coupled to said single column buffer, for storing a frame of data comprising a plurality of the stored columns;

a controller, coupled to said video memory, wherein said controller transfers the stored column from said single column buffer into said single frame buffer while image values from a corresponding stored column are not being read from said single frame buffer and after the stored column is completely stored in said single column buffer, and wherein said controller generates a predetermined image independent function having at least M values during a time slot;

a calculation engine, coupled to said controller and said video memory, wherein said calculation engine computes an image dependent output signal during the time slot, and wherein the image dependent output signal has N values, and wherein each of said N values is determined from the predetermined image independent function and one of N sets of image values, and wherein said calculation engine reads each of the N sets of image values from a different one of the plurality of the stored columns stored in the single frame buffer;

a row driver element, coupled to said controller and said active addressed display, wherein said row driver element generates M row voltages which are coupled to M row electrodes, and wherein each of the M row voltages is proportional to one of said at least M values during the time slot; and a column driver element, coupled to said calculation engine and said active addressed display, wherein said column driver element generates N column voltages which are coupled to N column electrodes, and wherein each of the N column voltages is proportional to one of said N values during the time slot.

8. A method for use in an electronic device which processes a input signal to generate an image on an active addressed display, wherein the input signal includes successive frames of data, wherein each of the successive frames of data defines a plurality of successively transmitted lines of image values, and wherein the plurality of successively transmitted lines have a line direction, the method comprising the steps of:

accumulating in a single line buffer a stored line comprising one of the plurality of successively transmitted lines of image values;

transferring the stored line into a single frame buffer which stores a frame of data comprising a plurality of the stored lines after the stored line is completely accumulated in said step of accumulating;

generating a predetermined image independent function having at least M values during a time slot;

reading a plurality of image values from one of the plurality of the stored lines stored in the single frame buffer;

computing one of N values of an image dependent output signal during the time slot, wherein each of the N values is determined from the predetermined image independent function and the plurality of image values read in said step of reading;

repeating said step of reading and said step of computing N times during the time slot, using a different one of the plurality of the stored lines for each repetition;

generating M first voltages during the time slot which are coupled to M first electrodes of the active addressed display, wherein each of the M first voltages is proportional to one of the at least M values of the predetermined image independent function; and generating N second voltages during the time slot which are coupled to N second electrodes of the active addressed display which have a direction corresponding to the line direction, wherein each of the N second voltages is proportional to one of the N values.

9. The method according to claim 8, wherein said step of transferring is not performed during said step of reading when the stored line stored in the single line buffer in said step of transferring corresponds to the one of the plurality of the stored lines stored in said single frame buffer in said step of reading.

10. An electronic device, comprising:

a microcomputer for transmitting an input signal including successive frames of data wherein each frame of data defines a plurality of successively transmitted lines of image values, wherein the plurality of successively transmitted lines have a line direction;

a display system, coupled to said microcomputer, which processes the input signal to generate an image, said display system comprising:

an active addressed display for displaying the image, wherein the active addressed display has a plurality of first electrodes and a plurality of second electrodes which cross each other at intersection points forming pixels, and wherein the plurality of second electrodes are in a direction corresponding to the line direction;

a video memory input signal, wherein the video memory comprises:

a single line buffer, coupled to said input signal, for accumulating a stored line comprising one of the plurality of successively transmitted lines of image values; and a single frame buffer, coupled to said single line buffer, for storing a frame of data comprising a plurality of the stored lines;

a controller, coupled to said video memory, wherein said controller transfers the stored line from said single line buffer into said single frame buffer after the stored line is completely stored in said single line buffer and generates a predetermined image independent function having at least M values during a time slot;

a calculation engine, coupled to said controller and said video memory, wherein said calculation engine computes an image dependent output signal during the time slot, and wherein the image dependent output signal has N values, and wherein each of said N values is determined from the predetermined image independent function and one of N sets of image values, and wherein said calculation engine reads each of the N sets of image values from a different one of the plurality of the stored lines stored in said single frame buffer;

a first driver element, coupled to said controller and said active addressed display, wherein during the time slot said first driver element generates M first voltages which are coupled to M first electrodes, and wherein each of the M first voltages is proportional to one of said at least M values; and a second driver element, coupled to said calculation engine and said active addressed display, wherein during the time slot said second driver element generates N second voltages which are coupled to N second electrodes, and wherein each of the N second voltages is proportional to one of said N values; and an enclosure coupled to the microcomputer and the display system for supporting and protecting the microcomputer and display system.

11. The electronic device according to claim 10, wherein said controller transfers the stored line into said single frame buffer while said calculation engine is not reading one of the N sets of image values from the one of the plurality of the stored lines stored in said single frame buffer which corresponds to the stored line stored in said single line buffer.

12. The electronic device of claim 10, wherein said single line buffer comprises a partial single line buffer for storing a predetermined portion of one of the plurality of successively transmitted lines of image values.

13. The electronic device of claim 10, wherein said single frame buffer comprises a partial single frame buffer for storing a predetermined portion of the plurality of successively transmitted lines of image values.

14. The electronic device of claim 10, wherein M and N are predetermined positive integers, and wherein a total duration of P time slots is substantially equivalent to a duration one of the successive frames of data, and wherein P is an integral power of 2, and wherein P is greater than M.

* * * * *